US010253452B2

(12) United States Patent
Hwang et al.

(10) Patent No.: US 10,253,452 B2
(45) Date of Patent: Apr. 9, 2019

(54) AUXILIARY MAT FOR VEHICLE AND APPARATUS FOR PROCESSING THE SAME

(71) Applicant: Hyundai Motor Company, Seoul (KR)

(72) Inventors: Min Ho Hwang, Osan-si (KR); Tae Hoon Song, Suwon-si (KR); Jong Heon Lee, Suwon-si (KR); Jum Yong Yoo, Yongin-si (KR)

(73) Assignee: Hyundai Motor Company, Seoul (KR)

( * ) Notice: Subject to any disclaimer, the term of this patent is extended or adjusted under 35 U.S.C. 154(b) by 996 days.

(21) Appl. No.: 14/528,065

(22) Filed: Oct. 30, 2014

(65) Prior Publication Data

US 2015/0167233 A1 Jun. 18, 2015

(30) Foreign Application Priority Data

Dec. 18, 2013 (KR) ..... 10-2013-0158186

(51) Int. Cl.
*D21H 23/36* (2006.01)
*D06N 7/00* (2006.01)

(52) U.S. Cl.
CPC ..... *D06N 7/0092* (2013.01); *D06N 7/0063* (2013.01); *D06N 7/0068* (2013.01); *D06N 7/0076* (2013.01); *D06N 2209/106* (2013.01); *Y10T 428/2481* (2015.01)

(58) Field of Classification Search
USPC ..... 118/256–258, 261, 262, 244, 224, 249, 118/253, 255, 259, 58–60, 66
See application file for complete search history.

(56) References Cited

U.S. PATENT DOCUMENTS

2005/0048245 A1 3/2005 Mullinax et al.

FOREIGN PATENT DOCUMENTS

| | | | |
|---|---|---|---|
| CN | 1251146 | A | 4/2000 |
| CN | 1590636 | A | 3/2005 |
| FR | 2886899 | A1 | 12/2006 |
| JP | 06-320994 | A | 11/1994 |
| JP | 2003-175758 | A | 6/2003 |
| KR | 10-2005-0123042 | A | 12/2005 |
| KR | 10-2009-0070897 | A | 7/2009 |
| TW | 200306378 | A | 11/2003 |
| TW | 1226916 | B | 1/2005 |
| WO | WO 98/38374 | A2 | 9/1998 |

*Primary Examiner* — Yewebdar T Tadesse
(74) *Attorney, Agent, or Firm* — Morgan, Lewis & Bockius LLP

(57) ABSTRACT

Disclosed are an auxiliary mat for a vehicle and an apparatus for processing the mat. The mat may include a fabric to form an exterior appearance, a bubble paper to which the fabric is threaded and coupled, a coating layer coated on the lower surface of the bubble layer, a backing layer coupled to a lower surface of the coating layer, an adhesive layer interposed between the coating layer and the backing layer, and serving as an adhesive for bonding the lower surface of the coating layer and an upper surface of the backing layer, and a plurality of protrusions coated on a lower surface of the backing layer, and formed in a shape protruding from the lower surface of the backing layer. The protrusions may be coated on the lower surface of the backing layer in a substantially uniform dot pattern.

7 Claims, 3 Drawing Sheets

AUXILIARY MAT FOR VEHICLE AND APPARATUS FOR PROCESSING THE SAME

CROSS-REFERENCE TO RELATED APPLICATION

The present application claims priority of Korean Patent Application Number 10-2013-0158186 filed on Dec. 18, 2013, the entire contents of which application are incorporated herein for all purposes by this reference.

BACKGROUND OF INVENTION

Field of Invention

The present invention relates to an auxiliary mat for a vehicle, and an apparatus for processing the same, and more particularly, to an auxiliary mat for a vehicle with an improved function and improved environmental friendliness, and an apparatus for processing the same.

Description of Related Art

In general, a floor panel is provided at an indoor floor of a vehicle, and a carpet is provided at an upper portion of the floor panel. The carpet serves a heat insulation function between the floor panel heated by heat of an engine and or exhaust heat inside the vehicle. Further, the carpet suppresses noise generated during travel of the vehicle from entering the indoor side. Furthermore, the carpet improves an interior design of the vehicle.

The carpet is provided under the foot of a passenger which is exposed to foreign materials that fall from shoes of the passenger. In addition, it is not easy to clean the carpet to which various foreign materials may be attached.

Accordingly, an auxiliary mat, which covers the carpet and is separated for cleaning to allow interior cleaning of the vehicle to be easily performed, is mainly used. The auxiliary mat may serve to improve an interior design instead of the carpet, and further suppress noise during travel of the vehicle from entering an indoor side of the vehicle. Further, when the auxiliary mat is adopted, it is possible to prevent the carpet from being damaged.

However, a passenger may be exposed to heavy metals or smell bad odor according to a material of the auxiliary mat. Particularly, the selection of a material of the auxiliary mat considering only a function, such as durability and a heat resisting property of the auxiliary mat, and frictional force of the auxiliary mat with the carpet, may further worsen a problem according to heavy metals and bad odor. In the meantime, considering an international trend, in which regulations considering environmental friendliness are actively established, and a pleasant indoor environment for a passenger, the auxiliary mat formed of an environmentally-friendly material is demanded.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

The present invention has been made in an effort to provide an auxiliary mat for a vehicle with an improved function and improved environmental friendliness, and an apparatus for processing the same.

Various aspects of the present invention provide an auxiliary mat for a vehicle, including: a fabric provided to form an exterior appearance exposed inside the vehicle; a bubble paper to which the fabric is threaded and coupled to pass through from an upper surface to a lower surface of the bubble paper and then pass through from the lower surface to the upper surface of the bubble paper; a coating layer coated on the lower surface of the bubble layer; a backing layer coupled to a lower surface of the coating layer; an adhesive layer interposed between the coating layer and the backing layer, and serving as an adhesive for bonding the lower surface of the coating layer and an upper surface of the backing layer; and a plurality of protrusions coated on a lower surface of the backing layer, and formed in a shape protruding from the lower surface of the backing layer.

The protrusions may be coated on the lower surface of the backing layer in a substantially uniform dot pattern. The adhesive layer may be made of a material comprising ethylene-vinyl acetate copolymer (EVA). The backing layer may be made of a felt. The protrusions may be made of a material comprising polyurethane (PU).

Various other aspects of the present invention provide an apparatus for processing an auxiliary mat for a vehicle, which processes a backing layer of the auxiliary mat, wherein the auxiliary mat comprises a fabric exposed to an indoor side of the vehicle, a bubble paper, to which the fabric is threaded and coupled, a coating layer coated on a lower surface of the bubble paper, and the backing layer coupled to a lower surface of the coating layer. The apparatus may include: an drawing roller for winding the backing layer to be processed, and configured to draw the wound backing layer in a predetermined direction; a J-box configured to receive the backing layer drawn from the drawing roller, and make the received backing layer be stayed at a predetermined temperature or a predetermined temperature range for a predetermined time; a dryer configured to dry the backing layer which passed through the J-box; a coating device configured to coat protrusions on one surface of the backing layer which passed through the dryer; a heat treatment device configured to heat treat the backing layer which passed through the coating device; and a collection roller for winding the backing layer processed by sequentially passing through the J-box, the dryer, the coating device, and the heat treatment device, and configured to collect the backing layer while winding the processed backing layer.

The coating device may coat the plurality of protrusions on the one surface of the backing layer in a substantially uniform dot pattern. The plurality of protrusions may be formed by coating the one surface of the backing layer with a material comprising PU.

The backing layer may be coated while passing between an upper coating roller and a lower coating roller, which are substantially vertically disposed in the coating device, the upper coating roller may be formed substantially in a hollow cylindrical shape with closed both surfaces, and a plurality of holes may be formed in a circumferential surface of the upper coating roller, and a PU binder coated on the one surface of the backing layer to form the protrusions may be included inside the upper coating roller.

A knife formed in a shape extended from a rotation shaft to an outer circumference of the upper coating roller may be mounted on the rotation shaft of the upper coating roller. The PU binder may be disposed in a direction opposite to a direction of a rotation of the upper coating roller based on the knife to be pressurized by the knife according to the rotation of the upper coating roller. The PU binder pressurized by the knife may be discharged to an outside of the upper coating roller through the holes.

The plurality of holes may be formed substantially at an equidistant interval in a direction of a circumference of the upper coating roller formed in the cylindrical shape. The plurality of holes may be formed substantially at an equidistant interval in a direction of the shaft of the upper coating roller formed in the cylindrical shape.

Yet various other aspects of the present invention provide an apparatus for processing an auxiliary mat for a vehicle, which processes a backing layer configuring a lower surface of the auxiliary mat to protect a carpet inside the vehicle, and fixing the auxiliary mat to the carpet, the apparatus including: a coating device configured to coat a plurality of protrusions on one surface of the backing layer substantially in a uniform dot pattern.

A material comprising PU may be coated on one surface of the backing layer, and the plurality of protrusions may be made of the material comprising PU.

The coating device may include: an upper coating roller disposed to pressurize the one surface of the backing layer, and formed substantially in a hollow cylindrical shape having closed both surfaces; and a lower coating roller disposed at a lower side of the upper coating roller to pressurize the other surface of the backing layer.

The backing layer may be coated while passing between the upper coating roller and the lower coating roller, and the upper coating roller may include: a plurality of holes formed in an outer circumferential surface of the cylindrical shape; a PU binder included in the hollow upper coating roller to be discharged through the plurality of holes; and a knife mounted on a rotation shape in a shape extended from the rotation shaft to an outer circumference of the upper coating roller to pressurize and discharge the PU binder.

The PU binder may be disposed in a direction opposite to a direction of a rotation of the upper coating roller based on the knife to be pressurized by the knife according to the rotation of the upper coating roller.

The plurality of holes may be formed substantially at an equidistant interval in a direction of a circumference of the upper coating roller formed in the cylindrical shape. The plurality of holes may be formed substantially at an equidistant interval in a direction of the shaft of the upper coating roller formed in the cylindrical shape.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
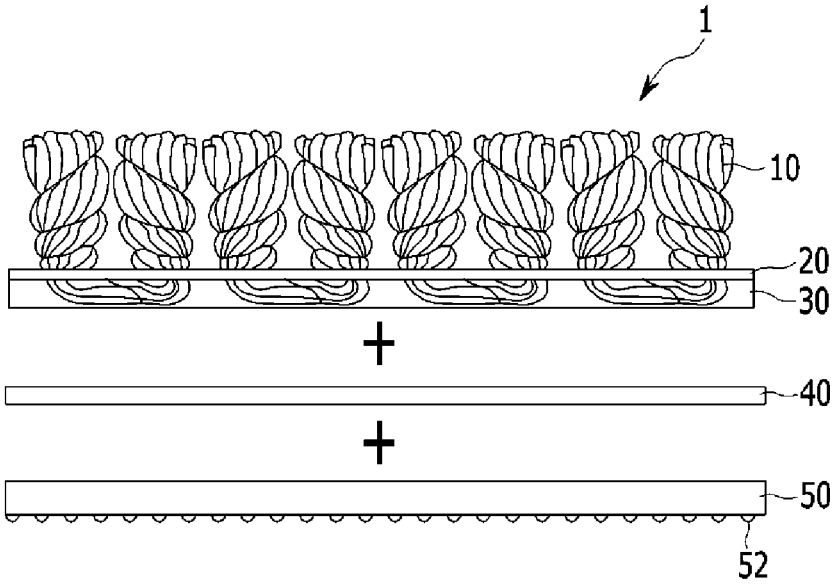
FIG. 1 is an exploded cross-side view illustrating an exemplary auxiliary mat for a vehicle according to the present invention.

FIG. 1 is an exploded cross-side view illustrating an auxiliary mat for a vehicle according to various embodiments of the present invention. As illustrated in FIG. 1, an auxiliary mat 1 for a vehicle according to various embodiments of the present invention includes fabric 10, a bubble paper 20, a coating layer 30, a backing layer 50, protrusions 52, and an adhesive layer 40.

The fabric 10 is disposed on an upper surface of the auxiliary mat 1, and forms an exterior appearance of the auxiliary mat 1. That is, the upper surface of the auxiliary mat 1 is a surface exposed to an indoor side of the vehicle, and the fabric 10 is a part of an interior design, so that an exterior appearance thereof is importantly regarded. The fabric 10 may be made of various materials according to a design or an application. For example, the fabric 10 may be made of bulked continuous filament (BCF). Here, the BCF is an abbreviation of bulked continuous filament, and is nylon textured yarn developed for a carpet. Further, hair growth or nap is not generated in the BCF, and the BCF has excellent volume and durability.

In the meantime, a lower surface of the auxiliary mat 1 is an opposed surface of the upper surface, and is a surface, which is in contact with a carpet provided to cover a floor panel of the vehicle. The description below is provided based on the upper surface and the lower surface of constituent elements of the auxiliary mat 1, and a direction of the upper surface and a direction of the lower surface of constituent elements of the auxiliary mat 1.

The bubble paper 20 is a paper including a space inside which air is present, and the fabric 10 is threaded to the bubble paper 20 to be coupled with each other. Further, the fabric 10 is threaded so as to pass through the bubble paper 20 from an upper surface to a lower surface of the bubble paper 20, and pass through the bubble paper 20 from the lower surface to the upper surface of the bubble paper 20. The bubble paper 20 coupled to the fabric 10 may be the same as or similar to that in the art, and thus detailed description thereof will be omitted.

The coating layer 30 is coated on the lower surface of the bubble paper 20 threaded with the fabric 10, and fixes a portion of the fabric 10 threaded with the bubble paper 20 to the bubble paper 20. That is, the coating layer 30 reinforces coupling force between the fabric 10 and the bubble paper 20. Further, the coating layer 30 may be made of a material, which has excellent elasticity, and is easily coated according to a design of a person skilled in the art. For example, the coating layer 30 may be made of latex. Here, the latex refers to particles of rubber which are dispersed in water and suspended in a shape of colloid, and includes natural rubber latex and synthetic rubber latex. The latex may be the same as or similar to that in the art, and thus detailed description thereof will be omitted.

The backing layer 50 is coupled to the coating layer 30. Further, an upper surface of the backing layer 50 is coupled to a lower surface of the coating layer 30. Further, a lower surface of the backing layer 50 is the lower surface of the auxiliary mat 1. That is, the lower surface of the backing layer 50 is in contact with the carpet. Further, the backing layer 50 is made of felt. Here, the felt is fabric obtained by compressing wool or artificial fiber by applying moisture and heat to the wool or the artificial fiber, and has excellent heat reservance and impact cushioning property.

In the meantime, the backing layer 50 prevents the auxiliary mat 1, which is in contact with the carpet, from being easily moved. Further, the auxiliary mat 1 is fixed to the carpet by frictional force between the backing layer 50 and the carpet, and the lower surface of the backing layer 50 is formed so as to improve frictional force.

The protrusions 52 are coated on the lower surface of the backing layer 50 so as to improve frictional force. Further, a plurality of protrusions 52 protrudes from the lower surface of the backing layer 50, and the lower surface of the backing layer 50 is formed in a concave-convex surface by the plurality of protrusions 52. Further, the protrusion 52 is formed of polyurethane (PU) or a material comprising PU or the like. The PU is an abbreviation of polyurethane, and has excellent elasticity, original state recovery, tension strength, elongation rate, and flexibility.

The adhesive layer 40 is interposed between the coating layer 30 and the backing layer 50. Further, the adhesive layer 40 serves as an adhesive bonding the lower surface of the coating layer 30 and the upper surface of the backing layer 50. Further, the adhesive layer 40 is made of ethylene-vinyl acetate copolymer (EVA) a material comprising EVA or the like.

Here, the EVA is an abbreviation of ethylene-vinyl acetate copolymer. The EVA is a polymer generated by copolymerizing ethylene and a vinyl acetate monomer, and as a content of vinyl acetate is increased, a density of EVA is increased, but a degree of crystallization deteriorates, so that flexibility is increased. Further, the EVA has excellent shock resistance, stress resistance, and cracking property. In the meantime, the EVA with a high concentration is used as a raw material of the adhesive.

Figure 2:
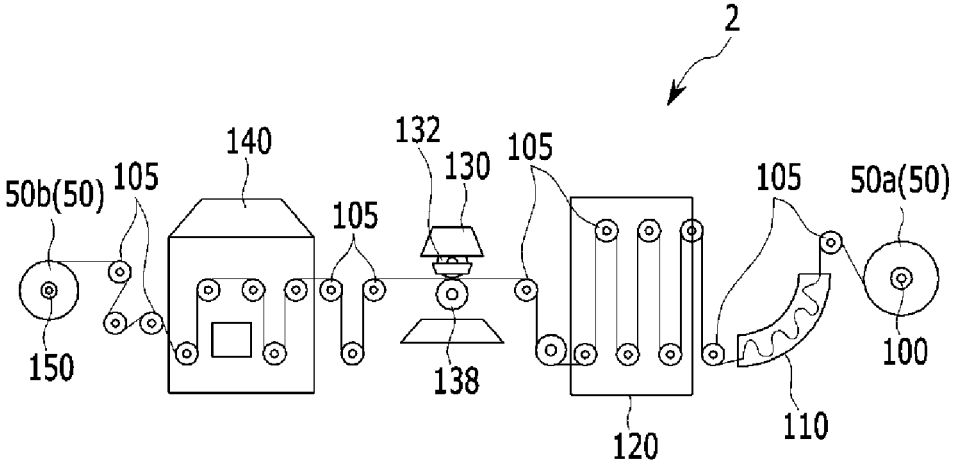
FIG. 2 is a schematic view illustrating an exemplary apparatus for processing an auxiliary mat for a vehicle according to the present invention.

FIG. 2 is a schematic view illustrating an auxiliary mat processing apparatus for a vehicle according to various embodiments of the present invention. As illustrated in FIG. 2, an auxiliary mat processing apparatus 2 of a vehicle according to various embodiments of the present invention is an apparatus for processing the backing layer 50 among the constituent elements of the auxiliary mat 1. Further, the auxiliary mat processing apparatus 2 includes a drawing roller 100, a collecting roller 150, moving rollers 105, a J-box 110, a dryer 120, a coating device 130, and a heat treatment device 140.

The drawing roller 100 is a roller around which the backing layer 50 to be processed by the auxiliary mat processing apparatus 2 is wound. That is, the drawing roller 100 is provided so that a non-processed backing layer 50*a* before the processing by the auxiliary mat processing apparatus 2 is wound around the drawing roller 100. Further, the drawing roller 100 is rotatably provided, and draws the non-processed backing layer 50*a* in a predetermined direction by a rotation.

The collecting roller 150 is a roller around which the backing layer 50 processed by the auxiliary mat processing apparatus 2 is wound. That is, the collecting roller 150 is provided so that a processed backing layer 50*b* after the processing by the auxiliary mat processing apparatus 2 is wound around the collecting roller 150. Further, the collecting roller 150 is rotatably provided, and collects the processed backing layer 50*b* while winding the processed backing layer 50*b* by a rotation.

The moving roller 105 is a roller provided so as to move the backing layer 50. A plurality of moving rollers 105 is provided between the drawing roller 100 and the collecting roller 150. Further, the moving roller 105 is rotatably provided, and moves the backing layer 50 from the drawing roller 100, by which the non-processed backing layer 50*a* is drawn, to the collecting roller 150, by which the processed backing layer 50*b* is collected, by the rotation.

In the meantime, the backing layer 50 drawn from the drawing roller 100 sequentially passes through the J-box 110, the dryer 120, the coating device 130, and the heat treatment device 140 while moving to the collecting roller 150 by the moving roller 105.

The J-box 110 receives the non-processed backing layer 50*a* from the collecting roller 150. Further, the backing layer 50 is stayed in the J-box 110 at a predetermined temperature or a predetermined temperature range for a predetermined time. In the meantime, the J-box 110 is a processing tank shaped like a letter "J", into which cloth padded with a processing liquid is fallen in a processing process of the cloth, and inside which the cloth is stayed at predetermined temperature for a predetermined time. The J-box may be the same as or similar to that in the art, and thus detailed description thereof will be omitted.

The dryer 120 is a device for drying the backing layer 50, which has passed through the J-box 110. Further, the backing layer 50 is dried while moving by the plurality of moving rollers 105 within the dryer 120.

The coating device 130 is a device for coating the lower surface of the backing layer 50, which has passed through the dryer 120, with PU configuring the protrusions 52. Further, the coating device 130 includes an upper coating roller 132 and a lower coating roller 138.

The upper coating roller 132 and the lower coating roller 138 are rollers disposed while being adjacent to each other so as to coat the backing layer 50. In the meantime, the upper coating roller 132 and the lower coating roller 138 may be vertically or substantially vertically disposed. Further, the backing layer 50 is moved by the moving roller 105 between the upper coating roller 132 and the lower coating roller 138 in a state of being pressurized by the upper coating roller 132 and the lower coating roller 138, so that PU is coated on the lower surface of the backing layer 50 and the protrusions 52 are formed on the lower surface of the backing layer 50.

The heat treatment device 140 is a device for drying and heat treating the backing layer 50, which has passed through the coating device 130. Further, the processed backing layer 50*b* passing through the heat treatment device 140 is collected at the collecting roller 150. In the meantime, the heat treatment of the coated fabric is apparent to those skilled in the art.

Figure 3:
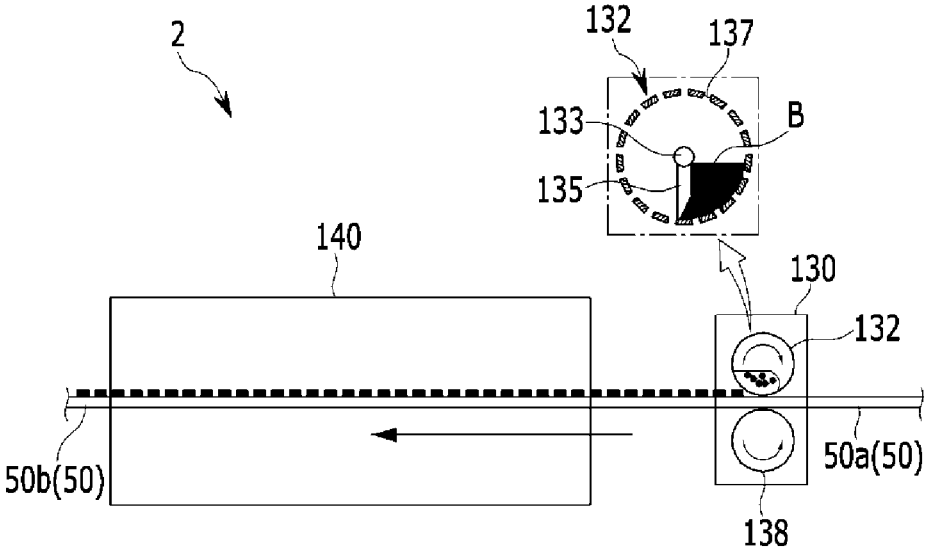
FIG. 3 is a partial configuration diagram of an exemplary apparatus for processing an auxiliary mat for a vehicle according to the present invention.

FIG. 3 is a partial configuration diagram of an apparatus for processing an auxiliary mat for a vehicle according to various embodiments of the present invention. As illustrated in FIG. 3, the upper coating roller 132 is formed in or substantially in a hollow cylindrical shape. Further, the cylindrical shape of the upper coating roller 132 includes a circumferential surface and both surfaces, and both surfaces of the upper coating roller 132 are closed. Further, a plurality of holes 137 is formed on the circumferential surface of the upper coating roller 132. Further, the plurality of holes 137 is formed at or substantially at an equidistant interval in a circumferential direction of the upper coating roller 132 formed in the cylindrical shape. In the meantime, the plurality of holes 137 is formed by or substantially an equidistant interval according to a direction of a shaft of the upper coating roller 132 formed in the cylindrical shape.

A PU binder B is included inside the upper coating roller 132, and a knife 135 is provided. The knife 135 is mounted to a rotation shaft 133 of the upper coating roller 132.

Further, the knife 135 is formed in a shape extended from the rotation shaft 133 toward the circumferential surface of the upper coating roller 132. Further, one end of the knife 135 extended toward the circumferential surface of the upper coating roller 132 pressurizes the PU binder B included in the upper coating roller 132. The PU binder B is disposed in a direction opposite to a direction of the rotation of the upper coating roller 132 based on the knife 135 so that the PU binder B is pressurized by the knife 135 according to the rotation of the upper coating roller 132.

The PU binder B pressurized by the knife 135 is discharged to the outside of the upper coating roller 132 through the holes 137. Further, when the PU binder B is discharged to the outside of the upper coating roller 132, one end of the knife 135 scratches the PU binder B, thereby preventing the PU binder B from being excessively discharged. That is, the amount of PU binder B discharged is determined by a shape of one end of the knife 135 and a size of the hole 137. In the meantime, the shape of one end of the knife 135 and the size of the hole 137 may be set so that the amount of PU binder B discharged has a predetermined value.

The PU binder B discharged by the predetermined value is coated on the lower surface of the backing layer 50. Further, the discharged PU binder B forms the dot-shaped protrusions 52 on the lower surface of the backing layer 50. Further, the dot-shaped protrusions 52 are uniformly or substantially uniformly formed by an interval corresponding to the interval of the holes 137 which are formed by the equidistant interval. That is, the protrusions 52 are formed in or substantially in a uniform dot pattern on the lower surface of the backing layer 50. In the meantime, the backing layer 50 passing between the upper coating roller 132 and the lower coating roller 138 is moved in a state where an upper side and a lower side of the backing layer 50 are inversed so that the protrusions 52 are easily coated on the lower surface of the backing layer 50.

As described above, according to various embodiments of the present invention, the backing layer 50 is made of felt, thereby securing environmental friendliness. Further, the adhesive layer 40 is made of EVA, thereby improving heat resistance and an adhesive property. Further, the protrusions 52 are coated on the lower surface of the backing layer 50 in a dot pattern, thereby improving marketability.

For convenience in explanation and accurate definition in the appended claims, the terms "upper" or "lower", "inside" or "outside", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An apparatus for processing an auxiliary mat for a vehicle, which processes a backing layer of the auxiliary mat, wherein the auxiliary mat comprises a fabric exposed to an indoor side of the vehicle, a bubble paper to which the fabric is threaded and coupled, a coating layer coated on a lower surface of the bubble paper, and the backing layer coupled to a lower surface of the coating layer, the apparatus comprising:

an drawing roller for winding the backing layer to be processed and configured to draw the wound backing layer in a predetermined direction;

a J-box configured to receive the backing layer drawn from the drawing roller, and make the received backing layer be stayed at a predetermined temperature or a predetermined temperature range for a predetermined time;

a dryer configured to dry the backing layer which passed through the J-box;

a coating device configured to coat protrusions on one surface of the backing layer which passed through the dryer;

a heat treatment device configured to heat treat the backing layer which passed through the coating device; and a collection roller for winding the backing layer processed by sequentially passing through the J-box, the dryer, the coating device, and the heat treatment device and configured to collect the backing layer while winding the processed backing layer;

wherein the coating device coats a plurality of protrusions on the one surface of the backing layer in a substantially uniform dot pattern, wherein the backing layer is coated while passing between an upper coating roller and a lower coating roller, which are substantially vertically disposed in the coating device, and wherein a knife formed in a shape extended from a rotation shaft of the upper coating roller to an outer circumference of the upper coating roller is mounted on the rotation shaft of the upper coating roller.

2. The apparatus of claim 1, wherein the plurality of protrusions is formed by coating the one surface of the backing layer with a material comprising PU.

3. The apparatus of claim 2, wherein:

the upper coating roller is formed substantially in a hollow cylindrical shape with closed both surfaces, and a plurality of holes is famed in a circumferential surface of the upper coating roller, and a PU binder coated on the one surface of the backing layer to form the protrusions is included inside the upper coating roller.

4. The apparatus of claim 3, wherein:

the PU binder is disposed in a direction opposite to a direction of a rotation of the upper coating roller based on the knife to be pressurized by the knife according to the rotation of the upper coating roller.

5. The apparatus of claim 4, wherein:

the PU binder pressurized by the knife is discharged to an outside of the upper coating roller through the holes.

6. The apparatus of claim 3, wherein:

the plurality of holes is formed substantially at an equidistant interval in a direction of a circumference of the upper coating roller formed in the hollow cylindrical shape.

7. The apparatus of claim 3, wherein:

the plurality of holes is formed substantially at an equidistant interval in a direction of the rotation shaft of the upper coating roller formed in the hollow cylindrical shape.

* * * * *